US005379085A

United States Patent [19]

Matsuda et al.

[11] Patent Number: 5,379,085

[45] Date of Patent: Jan. 3, 1995

[54] PHOTOSENSITIVE MATERIAL PROCESSING APPARATUS

[75] Inventors: Shinichi Matsuda; Jun Ikeda, both of Kanagawa, Japan

[73] Assignee: Fuji Photo Film Co., Ltd., Kanagawa, Japan

[21] Appl. No.: 87,316

[22] Filed: Jul. 8, 1993

[30] Foreign Application Priority Data

Jul. 14, 1992 [JP] Japan ..... 4-187091

[51] Int. Cl.[6] ..... G03D 3/08

[52] U.S. Cl. ..... 354/319; 354/321

[58] Field of Search ..... 354/324, 331, 336, 339, 354/340, 300; 134/64 P, 64 R, 122 P, 122 R; 355/283, 284, 285, 286, 300

[56] References Cited

U.S. PATENT DOCUMENTS 4,650,308 3/1987 Burbury ..... 354/324 X
4,829,330 5/1989 Yamada et al. ..... 354/322
5,023,464 6/1991 Mitsuya et al. ..... 355/283

FOREIGN PATENT DOCUMENTS 4155334 5/1992 Japan .

*Primary Examiner*—D. Rutledge
*Attorney, Agent, or Firm*—Sughrue, Mion, Zinn, Macpeak & Seas

[57] ABSTRACT

A photosensitive material processing apparatus having a plurality of rollers are disposed so that they either directly or indirectly contact a photosensitive material processed by at least one kind of processing solution. At least one of plurality of rollers is heated so as to dry the photosensitive material while it is being conveyed. A deposit removing member removes substances deposited on the circumferential surfaces of the rollers.

20 Claims, 10 Drawing Sheets

PHOTOSENSITIVE MATERIAL PROCESSING APPARATUS

BACKGROUND OF THE INVENTION

1. Field of the Invention

The present invention relates to a photosensitive material processing apparatus for drying a photosensitive material processed with processing solutions by a heat roller system.

2. Description of the Related Art

Conventionally, a photosensitive material is sequentially processed with processing solutions which are a developing solution, a fixing solution, and cleaning water and then dried by for example an automatic developing apparatus. In conventional drying process, warm air is blown onto a photosensitive material which has been treated with cleaning water so as to dry the photosensitive material.

However, with this method, when a large amount of photosensitive material is processed, the drying temperature of the drying process section is adversely affected. In addition, the thermal efficiency in the drying process is insufficient. On the other hand, with electronic advancements in recent years, the need for quick processing of photosensitive materials such as graphic art photosensitive material, scanner photosensitive material, and X-ray photosensitive material is becoming greater.

To quickly process such photosensitive materials, a photosensitive material processing apparatus having a drying process section using a heat roller system has been proposed as disclosed in Japanese Patent Application Laid-Open No. 4-155334. With reference to FIG. 19, an example of such an apparatus will be described in brief.

FIG. 19 is a partial sectional view showing a drying process section 300 of a photosensitive material processing apparatus of the type mentioned above. In the drying process section 300, a pair of a heat roller 310 and a press roller 312 are disposed. The rollers 310 and 312 nip and convey a film F from which most of the excessive water has been removed by a squeeze roller (not shown) in the preceding step. The heat roller 310 is provided with a cylindrical roller body 314. The roller body 314 is rotated in the direction of an arrow denoted by G by a motor (not shown). At an axial core portion of the roller body 314, a heating halogen lamp 316 is disposed for heating the roller body 314.

The press roller 312 is rotatably supported to the apparatus body by a bearing (not shown). The outer circumference of the press roller 312 is composed of an elastic substance 312A such as rubber. A portion of the press roller 312 presses against the circumferential surface of the heat roller 310. Therefore, the film F is nipped by a predetermined nipping pressure and conveyed by the heat roller 310 and the press roller 312 in the direction of arrow A shown in FIG. 19.

In the nipping and conveying step, water on the surface of the film F is squeezed off and then dried by heat from the heat roller 310. In the heat roller system, since the film F contacts the heat roller 310, the film F is directly heated by heat transferred therefrom. Thus, the thermal efficiency of this system is relatively high and the film F can be completely dried.

However, in the above-described heat roller system, water 320 which contains processing solutions and which adheres to the film F is squeezed off by the heat roller 310 and the press roller 312. The squeezed off water 320 is trapped in a triangle-shaped groove portion 318 defined by the heat roller 310 and the press roller 312.

After the film F has passed between the heat roller 310 and the press roller 312, there are cases when a certain amount of a time lapses until the next film F passes therethrough or the apparatus is stopped after the completion of the process. In such cases, the water 320 which is trapped in the groove portion 318 is evaporated by the heat of the heat roller 310. Thus, water-soluble polymers, sensitizing dye, calcium, and so forth which are dissolved in the water 312 are deposited in striped patterns on the surface of the press roller 312.

Thus, after the process is resumed, when the next film F contacts the heat roller 310 and the press roller 312, substances such as water-soluble polymers, sensitizing dye, and calcium deposited on the surface of the heat roller 310 and the press roller 312 are conveyed to the film F. Therefore, the deposited substances will contaminate the surface of the film F, thereby detracting from the image quality thereof.

SUMMARY OF THE INVENTION

Accordingly, an object of the present invention is to provide a photosensitive material processing apparatus which prevents the surface of photosensitive material from being contaminated by substances deposited thereon and thereby keeping the image quality from deteriorating, when a drying process is performed using a heat roller system.

A first aspect of the present invention is a photosensitive material processing apparatus, comprising a plurality of rollers whose circumferential surfaces are either directly or indirectly in contact with a photosensitive material processed by at least one kind of processing solution and a deposit removing means for removing substances deposited on the circumferential surfaces of the rollers. At least one of the rollers heats and drys the photosensitive material. The rollers are adapted to convey the photosensitive material. The deposit removing means comprises cleaning water supplying means for supplying cleaning water to circumferential surfaces of the rollers.

The second aspect of the present invention is the photosensitive material processing apparatus according to the first aspect, wherein the deposit removing means is a scraper means, in contact with the circumferential surfaces of the rollers, for scraping substances deposited thereon.

The third aspect of the present invention is the photosensitive material processing apparatus according to the first aspect, wherein the deposit removing means is an adhesive means, in contact with the circumferential surfaces of the rollers, for peeling off substances deposited thereon.

The fourth aspect of the present invention is a photosensitive material processing apparatus, comprising a plurality of first rollers whose circumferential surfaces are directly or indirectly in contact with a photosensitive material processed by at least one kind of processing solution, a plurality of second rollers which are provided corresponding to the number of the first rollers and being in contact with the circumferential surfaces of the first rollers, and deposit removing means for supplying cleaning water to the first corresponding rollers through the second rollers or for removing substances deposited on the circumferential surfaces of the first rollers at least one of the second rollers is heated so as to dry the photosensitive material while conveying the photosensitive material.

According to the first aspect of the present invention, a plurality of rollers are disposed so that their circumferential surfaces directly or indirectly contact the photosensitive material processed with processing solutions. In addition, at least one of the rollers is heated. Thus, the photosensitive material is dried by the roller while it is being conveyed by the plurality of rollers.

On the circumferential surface of the roller being heated, water is supplied by the cleaning water supply means. Thus, the processing solutions which adhere to the circumferential surfaces of the rollers transferred from the photosensitive material moistened therewith are kept in a non-dry condition. Therefore, the present invention can prevent components in the processing solutions from being deposited onto the circumferential surfaces of the rollers. As a result, the present invention can prevent the surface of the photosensitive material from being contaminated, thereby keeping the resultant images from being degraded.

According to the second aspect of the present invention, a plurality of rollers are disposed so that their circumferential surfaces contact the photosensitive material processed with processing solutions either directly or indirectly. In addition, at least one of the rollers is heated. The photosensitive material is dried by the roller while it is being conveyed by the plurality of rollers. The circumferential surface of the roller is provided with a scraper means so that the roller contacts the scraper means. Therefore, substances deposited on the circumferential surfaces of the rollers are scraped off and removed by the scraper means. Thus, the present invention can prevent the surface of the photosensitive material from being contaminated, thereby keeping the resultant image from being degraded.

According to the third aspect of the present invention, a plurality of rollers are disposed so that their circumferential surfaces contact the photosensitive material processed with processing solutions either directly or indirectly. In addition, at least one of the rollers is heated. The photosensitive material is dried by the roller while it is being conveyed by the plurality of rollers. An adhesive means contacts the circumferential surface of the roller. The adhesive means peels off substances deposited on the circumferential surfaces of the rollers. Thus, the present invention can prevent the surface of the photosensitive material from being contaminated, thereby keeping the resultant image from being degraded.

According to the fourth aspect of the present invention, a water absorbing roller is disposed so that it contacts the circumferential surfaces of a plurality of rollers. In addition, a deposit removing means which supplies cleaning water to the rollers through the water absorbing roller and removes substances deposited on the circumferential surface of the water absorbing roller is provided. Therefore, the present invention can prevent components of the processing solutions from depositing on the circumferential surfaces of the rollers or absorb water containing the processing solutions which adheres to the circumferential surfaces of the rollers by the water absorbing roller. Since the deposit removing means removes the water or substances deposited thereon, the present invention can prevent the surface of the photosensitive material from being contaminated. Thereby the resultant image is not degraded. In addition, the present invention can prevent the circumferential surfaces of the rollers from being damaged. The present invention can also prevent components in the processing solutions from being deposited on the circumferential surfaces of the rollers. Thus, the present invention can prevent the photosensitive material from being contaminated, thereby keeping the resultant images from being degraded.

These and other objects, features and advantages of the present invention will become more apparent in light of the following detailed description, as illustrated in the accompanying drawings.

BRIEF DESCRIPTION OF THE DRAWINGS

FIG. 18 is an enlarged sectional view showing a fifth modified led example of the backup rollers of FIG. 13, the backup rollers being used for the principal portions of FIG. 17.

DETAILED DESCRIPTION OF THE PREFERRED EMBODIMENTS

Next, with reference to FIGS. 1 to 3, an embodiment of the present invention will be described in detail. In the figures, the direction denoted by the arrow A is the downward direction and the direction denoted by the inverted arrow A is the upward direction.

Figure 2:
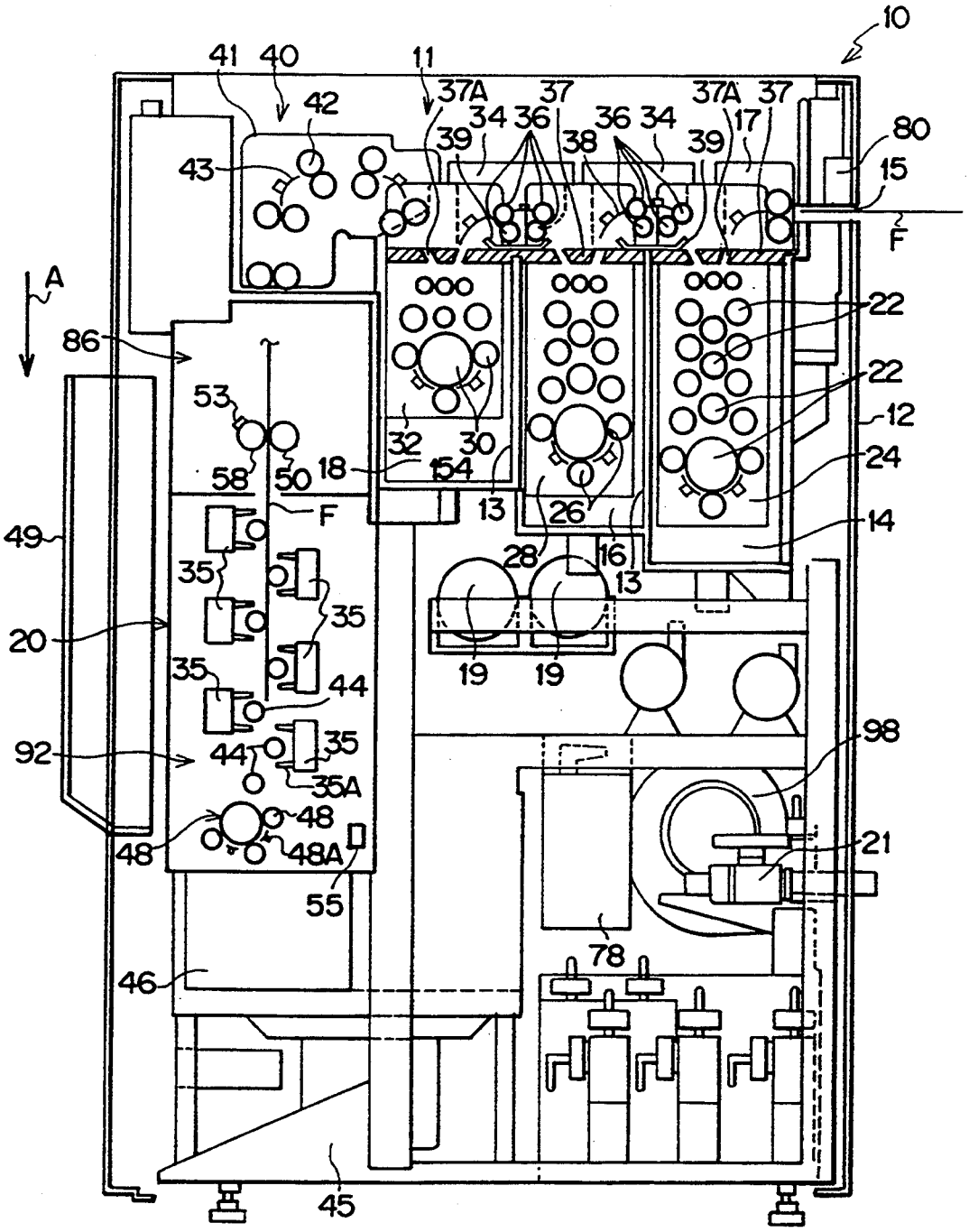
FIG. 2 is a sectional view showing the schematic construction of an automatic developing apparatus according to the embodiment of the present invention.

Referring to FIG. 2, an automatic developing apparatus 10 as a photosensitive material processing apparatus is shown. With reference to this figure, the overall construction of the automatic developing apparatus 10 will be described.

The automatic developing apparatus 10 is provided with a frame 12. At a side of the frame 12, a film inlet for a film F is provided. In the vicinity of the film inlet 15, a loading rack 17 for loading the film F into the automatic developing apparatus 10 is disposed. In the vicinity of the film inlet 15, a film loading detection sensor 80 which detects the film F being loaded is disposed. In the vicinity of the film inlet 15 of the automatic developing apparatus 10, a loading table for manually loading the film F, an auto feeder for automatically loading the film F by a conveying means, or the like may be provided.

In the frame 12, a processing section 11 and a drying section 20 are disposed which will be described hereinunder.

In the processing section 11, a developing tank 14. A fixing tank 16, and a water-cleaning tank 18 are disposed in the conveying direction of a photosensitive material (hereinafter, the photosensitive material is referred to as the film F). In this embodiment, the film F is composed of a polymer resin base, emulsion, and so forth. These tanks 14, 16, and 18 are partitioned from each other by partition walls 13.

The developing tank 14 stores developing solution. In the developing tank 14, a conveying rack 24 having a plurality of conveying rollers 22 is submerged in the developing solution. The conveying rollers 22 are driven by a motor (not shown) so as to convey the film F. The fixing tank 16 stores a fixing solution. The fixing solution may be of a kind that does not substantially contain a hardening agent. In the fixing tank 16, a conveying rack 28 having conveying rollers 26 is submerged in the fixing solution. The conveying rollers 26 are driven by a motor (not shown) so as to convey the film F. The water-cleaning tank 18 stores cleaning water. In the water-cleaning tank 18, a conveying rack 32 having conveying rollers 30 is submerged in the cleaning water. The conveying rollers 30 are driven by a motor (not shown) so as to convey the film F.

Under the processing tanks, two heat exchangers 19 are disposed. The developing solution in the developing tank 14 and the fixing solution in the fixing tank 16 are supplied to the heat exchangers 19 by pumps (not shown). After the developing solution and the fixing solution are heat-exchanged, they are returned to the developing tank 14 and the fixing tank 16, respectively. Thus, the temperature of the developing solution in the developing tank 14 and that of the fixing solution in the fixing tank 16 are kept within their predetermined ranges. Underneath the developing tank 14, an exhaust fan 98 is disposed. The exhaust fan 98 exhausts gases, vapor, and so forth which are generated in the processing section 11 to the outside of the automatic developing apparatus 10.

Crossover racks 34 are disposed between the developing tank 14 and the fixing tank 16 and between the fixing tank 16 and the water-cleaning tank 18. Each crossover rack 34 has nipping and conveying roller pairs 36 and a guide 38 for guiding film F. The nipping and conveying roller pairs 36 convey the film F from an upstream tank to a downstream tank.

Floating covers 37 which cover the opening portions of the processing tanks are disposed at positions near the surface levels of the processing solutions stored in the developing tank 14, the fixing tank 16, and the water-cleaning tank 18. The replenishing amount of each processing solution is adjusted corresponding to the processing amount of the film F or to a signal received from a processing solution level sensor (not shown) in each processing tank. The floating covers 37 each have an opening 37A defined along the conveying path of the film F. The opening 37A serves as a guide for guiding the film F. The film F passes through the opening 37A. Since the floating cover 37 decreases the exposure of the processing solution to air, deterioration of each processing solution, such as through oxidizing, decreases. In addition, the amount of water which evaporates in a unit of time decreases. Therefore, the amount of solutions and water to be replenished into the processing tanks can be reduced.

At bottom portions of the developing tank 14, the fixing tank 16, and the water-cleaning tank 18, drain pipes (not shown) are disposed. Each drain pipe has a drain valve 21. Thus, by opening the drain valves 21, the developing solution, the fixing solution, and the cleaning water can be drained from the developing tank 14, the fixing tank 16, and the water-cleaning tank 18, respectively.

A squeeze portion 40 is disposed between the water-cleaning tank 18 and the drying section 20. The squeeze section 40 has a squeeze rack 41. The squeeze rack 41 comprises a nipping and conveying roller pair 42 and a guide 43 for guiding the film F. The nipping and conveying roller pair 42 conveys the film F, onto which cleaning water adheres, from the cleaning tank 18 to the drying section 20 while squeezing off the adhering cleaning water.

The drying section 20 comprises a first drying portion 86 and a second drying portion 92. The first drying portion 86 is disposed upstream from the conveying direction from the film F. The second drying portion 92 is disposed downstream of the conveying direction of the film F. The conveying path of the film F in the drying section 20 is the direction of arrow A shown in FIG. 2.

On one side of the conveying path of the film F in the first drying portion 86, a heat roller 50 is disposed along the conveying path of the film F. On the other side of the conveying path, a nip roller 58 which is paired with the heat roller 50 is disposed.

Figure 1:
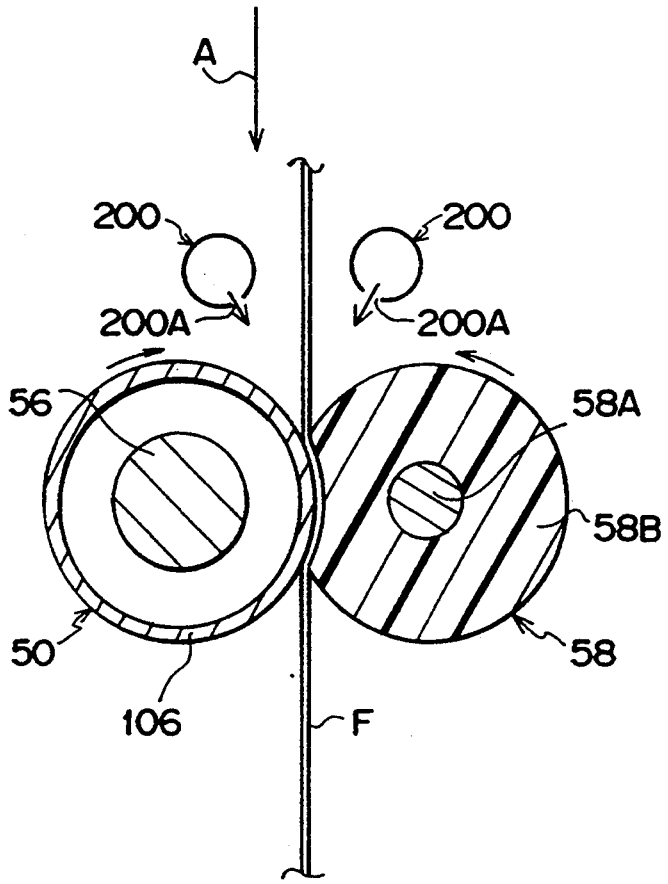
FIG. 1 is an enlarged partial sectional view showing a cleaning water supply means, a heat roller, and a nip roller which are principal portions of an embodiment of the present invention.

As shown in FIG. 1, the heat roller 50 comprises a cylindrical roller body 106 and a heating halogen lamp 56 which is disposed in the axial core portion thereof. The roller body 106 is made of an aluminum alloy pipe having a high thermal transfer property. The roller body 106 is circumferentially coated with Teflon, thereby having a high water repellent property. One axial end of the roller body 106 is coaxially fixed to a gear (not shown). Through the gear, the roller body 106 is rotated via a drive force of a drive means (not shown). One axial end of the heating halogen lamp 56 is connected to a cable (not shown). By energizing the heating halogen lamp 56, radiant heat of the halogen lamp 56 heats roller body 106. It should noted that an infrared heater may be used instead of the heating halogen lamp 56.

The nip roller 58 comprises a metal shaft 58A and a cylindrical roll portion 58B whose outer circumference is made of an elastic substance such as rubber. The nip roller 58 is rotatably supported by a bearing (not shown). The outer circumference of the roll portion 58B is coated with a thin-walled Teflon tube (not shown), thereby providing a high water repellent property. The nip roller 58 is pressed against the heat roller 50 so as to allow the film F to be nipped therebetween with a predetermined nipping pressure. Thus, while the nip roller 58B is pressed against the heat roller 50, the roller portion 58B of the nip roller 58 elastically deforms to some extent. Thus, the film F is in surfacecontact with the surface of the heat roller 56 so that it is uniformly dried. The drying efficiency is thereby improved.

The axial lengths of the nip roller 58 and the heat roller 50 are larger than the width of the film F by a predetermined value.

Below the second drying portion 92, a drying fan 45 and a chamber 46 are disposed. The drying fan 45 delivers air outside the automatic developing apparatus 10 into the chamber 46 (for drying purpose). The chamber 46 has a heater (not shown). The chamber 46 heats the air delivered by the drying fan 45 and sends it into the second drying portion 92. In this embodiment, drying air is heated by the heater. However, the air may be at ambient temperature.

A temperature detecting sensor 53 is disposed on the circumferential surface of the heat roller 50 in the first drying portion 86. The temperature detecting sensor 53 is connected to a control unit (not shown). The control unit controls the temperature of the heat roller 50 on the basis of information received from the temperature detecting sensor 53, the ambient temperature and humidity, the drying load (the film processing amount per time unit), the predetermined conditions, and so forth. The surface temperature of the heat roller 50 according to this embodiment may be varied in the range from 50° C. to 150° C. Normally the range varies from 60° to 100°. When the halogen lamp heating the heat roller 50 is of a low heat generation type, the temperature detecting sensor 53 need not be disposed on the circumferential surface of the heat controller 50. In addition, drying air at ambient temperature or heated drying air may be delivered to the first drying portion 86. The temperature of the drying air is controlled by the output of a heater (not shown) on the basis of information such as ambient temperature and humidity, the temperature in the first drying portion 86, and so forth.

On both the sides of the conveying path of the film F in the second drying portion 92, a plurality of conveying rollers 44 are disposed in a zigzag pattern. The conveying rollers 44 are rotated via a drive force generated by a drive means (not shown). Thus, the conveying rollers 44 downwardly convey the film F which has passed through the first drying portion 86. On the opposite side of the conveying path of the film F which is conveyed by the conveying rollers 44, a drying air blowing pipe 35 is disposed. The drying air blowing pipe 35 has a pair of blowing portions 35A which extend toward the conveying path of the film F. The second drying portion 92 has a temperature detecting sensor 55. The control unit controls the heating temperature of the heater (not shown) on the basis of the information received from the temperature detection sensor 55, ambient temperature and humidity, the drying load (film processing amount per time unit), the predetermined conditions, and so forth so as to deliver drying air into the second drying portion 92.

At a lower portion of the second drying portion 92, a plurality of conveying rollers 48 and a guide 48A are disposed. The conveying rollers 48 and the guide 48A direct the film F in an upperly slant direction and deliver it to the outside of the drying section 20.

On one side of the drying section 20, a receiving box 49 which extrudes from the outer wall of the automatic developing apparatus 10 is disposed. The receiving box 49 holds the film F unloaded from the drying section 20.

In the automatic developing apparatus 10, behind the view of the squeeze rack 41 shown in FIG. 2, a water supply tank (not shown) is disposed into which tap water is supplied. Inside the water supply tank, a water level sensor (not shown) is disposed. The water level sensor detects the level of water in the water supply tank so as to determine whether or not tap water should be supplied into the water supply tank.

The water supply tank and the water-cleaning tank 18 are connected by a pipe (not shown). In addition, the water supply tank and the water-cleaning tank 18 are disposed so that the water level of the water supply tank accords with that of the water-cleaning tank 18. Water is replenished by the opening and closing of a solenoid valve (not shown) disposed in the middle of a pipe which connects the water tap to the water supply tank according to the detection of the film F by the film insertion detecting sensor 80 disposed in the vicinity of the film inlet 15 of the automatic developing apparatus 10.

As shown in FIG. 2, the automatic developing apparatus 10 has a cleaning pump 78 which cleans the guide plate 38 and the rollers 36 disposed in the crossover rack 34. The cleaning pump 78 sprays tap water into the water supply tank through a spray pipe (not shown) disposed on the upper surface of the partition walls 13 so as to clean the guide plate 38 and the rollers 36 disposed in each of the crossover racks 34. The cleaning water contains an antibiosis agent so as to prevent the cleaning water spraying opening (not shown) of the spray pipe from clogging with algae which propagate therein. The guide plate 38 and the rollers 36 disposed in each crossover rack 34 are cleaned whenever the day's operation of the automatic developing apparatus 10 is completed.

As shown in FIG. 1, above the heat roller 50 and the nip roller 58, a pair of cleaning water supply pipes 200 which serve as a cleaning water supply means sandwich the conveying path therebetween. Cleaning water is supplied to the cleaning water supply pipes 200 from a water supply pump (not shown). The operation of the water supply pump is controlled by a control unit (not shown). In a portion of the circumference of each of the cleaning water supply pipes 200, an opening 200A is defined. The cleaning water is sprayed from the opening 200A in the direction of the arrow shown in FIG. 1. In other words, the cleaning water is sprayed at the portions where the circumference of the roller body 106 of the heat controller 50 and the circumference of the roll portion 58B of the nip roller 58 intersect with the film F. In this embodiment, the spraying amount of the cleaning water is set at 0.2 to 2 cc/squirt. The cleaning water may be continuously sprayed while the automatic developing apparatus is being operated if desired. In addition, the cleaning water may be sprayed at predetermined intervals if so desired. In other words, after the film F which has been inserted into the automatic developing apparatus 10 is detected by the film insertion detecting sensor 80 (after a predetermined time has elapsed), just before the film F passes through the path defined by the heat roller 50 and the nip roller 58 which are in opposed relation, the cleaning water may be sprayed. After the film F has passed through the path defined by the heat roller 50 and-the nip roller 58 and the next film F passes through this path, the cleaning water may be sprayed so as to prevent substances from depositing on the circumferential surfaces of the rollers 50 and 58.

In the case where the automatic developing apparatus 10 has processed the film F with the processing solutions and the film F has been dried, when the operation of the automatic developing apparatus 10 is stopped, the cleaning water may be sprayed with the spraying amount of 0.2 to 2 cc/squirt after the film F is inserted from the film inlet 15.

Next, the operation of this embodiment will be described.

The film F inserted from the film inlet 15 into the automatic developing apparatus 10 is inserted into the developing tank 14 by the insertion rack 17 and then conveyed through the developing solution by the conveying rollers 22 in the developing tank 14. Thus, the film F is developed. The developed film F is conveyed to the fixing tank 16 by the crossover rack 34. Here, the film F is conveyed through the fixing solution by the conveying rollers 26. Thus, the fixing process is performed. The fixed film F is conveyed to the cleaning tank 18 by the crossover tank 34. Here, the film F is conveyed through the cleaning water by the conveying rollers 30. Thus, the cleaning process is performed.

Next, the cleaned film F is conveyed to the squeezing section 40. At this point, the film F has a large amount of water adhere thereto. The emulsion layer formed on the base of the film F also contains a large amount of water. In the squeezing section 40, the film F is nipped and conveyed by the nipping and conveying roller pair 42. Accordingly, water containing components such as fixing solution and water containing components of the emulsion layer are squeezed from the film F. The film F is then conveyed to the drying section 20.

After the film F has been conveyed to the drying section 20, it is nipped by the nip roller 58 and the heat roller 50, thereby squeezing off water on the surface of the film F and water contained in the emulsion layer. The film F is then dried by heat transferred from the heat roller 50. At this time, with warm air delivered from the drying fan 45 and the chamber 46 to the first drying portion 86, the drying process may be accelerated. The film F heated by the heat roller SO is then conveyed to the second drying portion 92.

In the second drying portion 92, the film F is exposed to drying air delivered from the opening of the blowing portion 35A of the drying air blowing pipe 35. Thus, water which remains on the film F and water contained in the emulsion layer will evaporate.

Thereafter, the film from which water has been evaporated is unloaded from the drying section 20 and held in the receiving box 49.

just before the film F is conveyed to the path defined by the heat roller 50 and the nip roller 58, cleaning water is sprayed from the cleaning water supply pipes 200. Since the sprayed cleaning water is supplied to the portion where the heat roller 50 and the film F intersect and to the portion where the nip roller 58 and the film F intersect, water in the processing solutions does not evaporate on the circumferential surfaces of the heat roller 50 and the nip roller 58. Hence, composites in the processing solutions are not deposited thereon. In other words, while the film F is passing through the path defined by the heat roller 50 and the nip roller 58, the circumferential surfaces of these rollers are kept in a non-dry condition.

As described above, in this embodiment, unlike the conventional drying apparatus which nips and conveys the film F by means of the heat roller and the press roller, substances do not adhere to the surface of the film F, thereby preventing the surface thereof from being contaminated. Therefore, the film F can be conveyed and dried without deterioration of the image quality thereof.

In this embodiment, the pair of cleaning water supply pipes 200 are disposed nearly over the heat controller 50 and the nip controller 58. However, the cleaning water supply pipes 200 may be constructed according to the Following modified examples as shown in FIGS. 3 to 18. The modified examples may be roughly categorized as (1) cleaning water supply type where cleaning water is supplied to at least one of the heat roller 50 and the nip roller 58 (see FIGS. 3 to 8), (2) contact type where substances deposited are scraped from the heat roller 50 and the nip roller 58 by a scraper means which contacts these rollers (see FIGS. 9 to 11), (3) adhesive type where substances deposited are removed from the heat roller 50 and the nip roller 58 by an adhesive means (see FIG. 12), (4) indirect types where substances are indirectly removed by a cleaning means, a scraper means, or an adhesive means (see FIGS. 13 to 18). Next, each modified example will be described one after the other.

Figure 3:
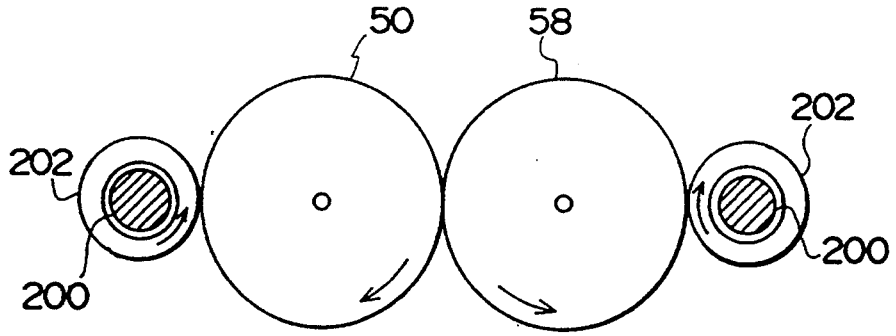
FIG. 3 is an enlarged sectional view according FIG. 1 showing a first modified example of the cleaning water supply means of the principal portions of the present invention.

In the modified example shown in FIG. 3, a pair of backup rollers 202 are disposed adjacent to the heat roller 50 and the nip roller 58 so that the circumferential surfaces of the backup rollers 202 contact the heat roller 50 and the nip roller 58. The backup rollers 202 are cylindrical members having water absorbing properties. The backup rollers 202 are rotatably disposed. At the axial core of each backup roller 202, the cleaning water supply pipe 200 is disposed. The cleaning water supply pipe 200 is not rotatable. The cleaning water sprayed from the cleaning water supply pipe 200 is absorbed in the backup roller 202. The backup roller 202 applies the cleaning water on the circumferential surfaces of the heat roller 50 and the nip roller 58. As the cleaning water, a variety of solutions which contain a slight amount of the component of the fixing solution may be used.

Figure 4:
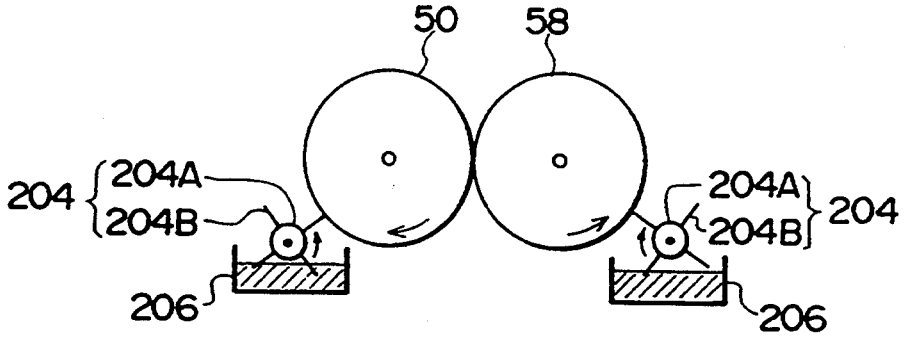
FIG. 4 is an enlarged sectional view according to FIG. 1 showing a second modified example of the cleaning water supply means of the principal portions of the present invention.

In the modified example shown in FIG. 4, a blade roller 204 and a water supply tank 206 are each disposed adjacent to the heat roller 50 and the nip roller 58. The blade roller 204 comprises a roller body 204 and four blades 204B. The roller body 204A is disposed at the axial core of the bladed roller 204. The four blades 204B are disposed on the outer circumference of the roller body 204A at intervals of 90°. The blades 204B have water absorbing properties. As the roller body 204A rotates, the edges of the blades contact the circumferential surface of the heat roller 50 and the nip roller 58. The level of water accommodated in the water supply tank 206 is set so that as the roller body 204A rotates, the edges of the blades 204B are submerged in the water. Thus, as the heat roller 50 and the nip roller 58 rotate, the bladed roller 204 also rotates. As a result. cleaning water is applied from the blades 204A to the circumferential surfaces of the heat roller 50 and the nip roller 58. Besides the cleaning water, a solution which slightly contains a slight amount of the component of the fixing solution or the like may be used.

Figure 5:
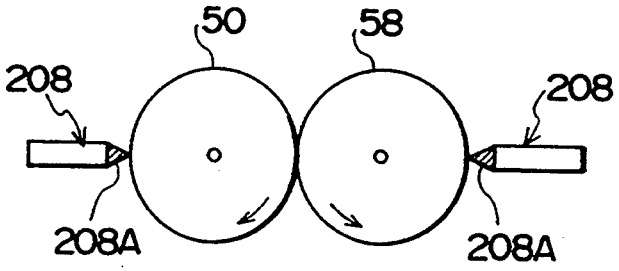
FIG. 5 is an enlarged sectional view according to FIG. 1 showing a third modified example of the cleaning water supply means of the principal portions of the present invention.

In the modified example shown in FIG. 5, blades 208 make contact with the heat roller 50 and the nip roller 58. An edge portion of the blade 208 has water absorbing properties. The edge portions 208A of the blades 208 contact the circumferential surfaces of the heat roller 50 and the nip roller 58. Accordingly, as the heat roller 50 and the nip roller 58 rotate, water is supplied to the edge portion 208A of each blade 208 by a cleaning water supply means such as a cleaning water supply pipe (not shown). Thus, the water is applied to the circumferential surfaces of the heat roller 50 and the nip roller 58. In this modified example, besides water being applied to the surfaces of the rollers, a solution which contains a slight amount of the component of the developing solution or the like may be used.

Figure 6:
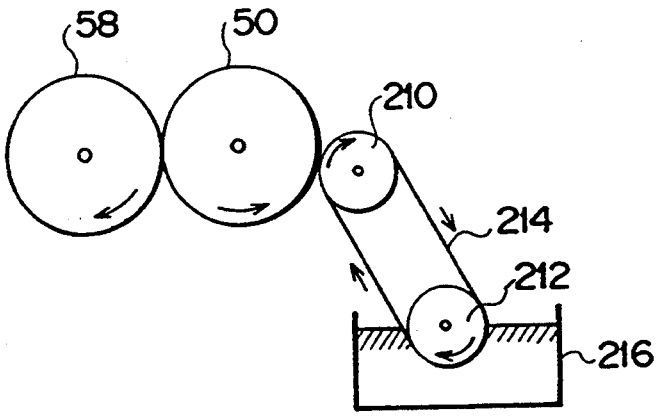
FIG. 6 is an enlarged sectional view according to FIG. 1 showing a fourth modified example of the cleaning water supply means of the principal portions of the present invention.

In the modified example shown in FIG. 6, a roller 210 is disposed adjacent to the circumferential surface of the heat roller 50. At a position opposed to the roller 210, a roller 212 is disposed. A belt 214 is wound around the rollers 210 and 212. The belt 214 is made of cloth which has water absorbing properties. The lower half of the roller 212 is submerged in the cleaning water stored in the water supply tank 216. Thus, as the heat roller 50 rotates, the belt 214 rotates and applies the cleaning water onto the circumferential surface of the heat roller 50. In addition, the belt 214 soaks up the processing solutions which adhere to the circumferential surface of the heat roller 50. Accordingly, the processing solutions are cleaned off the belt 214 in the water supply tank 216.

Figure 7:
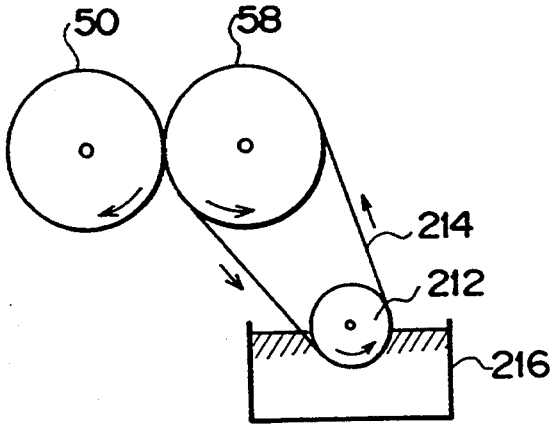
FIG. 7 is an enlarged sectional view according to FIG. 1 showing a fifth modified example of the cleaning water supply means of the principal portions of the present invention.

In the modified example shown in FIG. 7, the roller 210 shown in FIG. 6 is omitted. Instead, the belt 214 is directly wound around the circumferential surface of the nip roller 58. In this modified example, the same operation as the modified example shown in FIG. 6 may be obtained.

Figure 8:
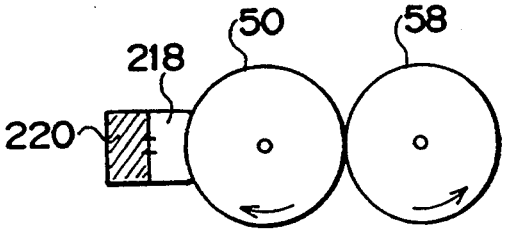
FIG. 8 is an enlarged sectional view according to FIG. 1 showing a sixth modified example of the cleaning water supply means of the principal portions of the present invention.

In the modified example shown in FIG. 8, one side of a sponge 218 is pressed to the circumferential surface of the heat roller 50. The reverse side of the sponge 218 is attached to a cleaning water supply pipe 220. Accordingly, water from the cleaning water supply pipe 220 penetrates through the sponge 218. Thus, as the heat roller 50 rotates, cleaning water is applied to the circumferential surface thereof. Instead of sponge, any material which has water absorbing properties may be used.

Figure 9:
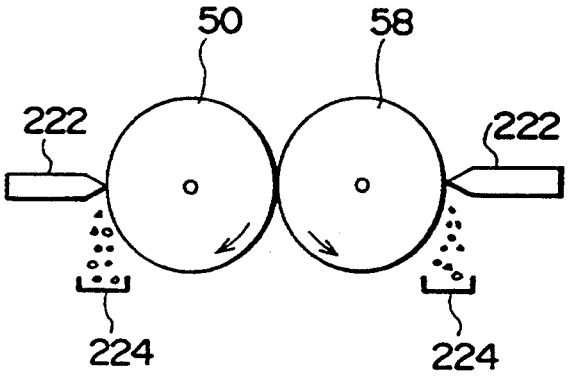
FIG. 9 is an enlarged sectional view according to FIG. 1 showing a scraper means of the principal portions of the present invention, the scraper means using blades.

In the modified example shown in FIG. 9, blades serving as scraper means are disposed so as to contact the circumferential surfaces of the heat roller 50 and the nip roller 58. After the film F has been heated by the heat roller 50 during conveyance by the nip roller 58, a predetermined period of time elapses. Accordingly, substances have been deposited on the heat roller 50 and the nip roller 58. Thereafter, the edge portions of the blades 222 move so as to contact the circumferential surfaces of the heat roller 50 and the nip roller 58. Thus, the substances deposited on the circumferential surfaces of the heat roller 50 and the nip roller 58 are scraped off. The scraped substances fall into containers 224 disposed just below the blades 222. In addition, before the film F to be dried is nipped so as to come into contact with the heat roller 50 and the nip roller 58, the blades 222 move so that they do not make contact with the circumferential surfaces of the heat roller 50 and the nip roller 58. If desired, the blades 222 may be placed in continuous contact with the heat roller 50 and the nip roller 58.

Figure 10:
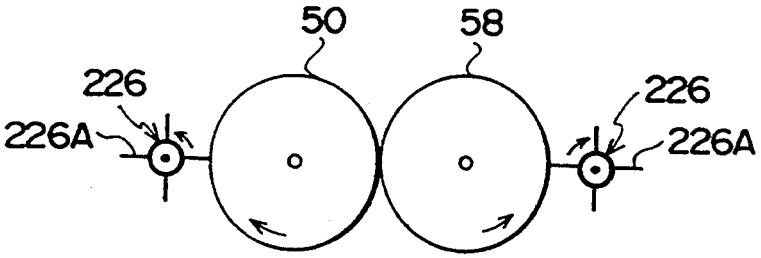
FIG. 10 is an enlarged sectional view according to FIG. 9 showing a first modified example of the scraper means of the principal portions of the present invention.

In the modified example shown in FIG. 10, bladed rollers 226 are disposed adjacent to the heat roller 50 and the nip roller 58. On the circumferential surface of each bladed roller 226, blades 226A are disposed at predetermined intervals. The blades 226A contact the circumferential surfaces of the heat roller 50 and the nip roller 58. As the heat roller 50 and the nip roller 58 rotate, substances deposited on the circumferential surfaces of the heat roller 50 and the nip roller 58 are scraped off. As with the example shown in FIG. 12 (which will be described later), the bladed rollers 226 may be controlled such that the blades 226A only contact the circumferential surfaces of the heat roller 50 and the nip roller 58 when substances are deposited on the circumferential-surfaces thereof. If desired, the blades 226A may be in continuous contact with the circumferential surfaces of the heat roller 50 and the nip roller 58.

Figure 11A:
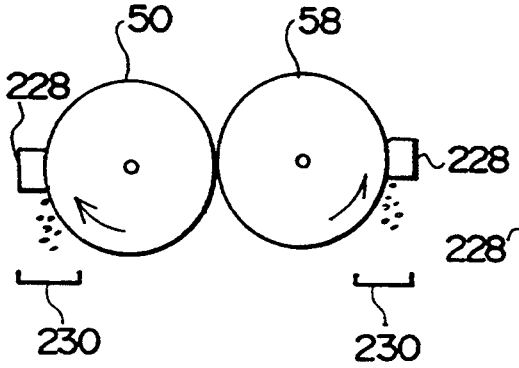
FIG. 11A is an enlarged sectional view according to FIG. 9, the heat roller and the nip roller being in opposed relation, showing a second modified example of the scraper means of the principal portion of the present invention.

In the modified example shown in FIG. 11A, cleaners are disposed so as to contact the circumferential surfaces of the heat roller 50 and the nip roller 58. The clearer 228 is composed of a sponge and a polyimide tape which is wound therearound. At a predetermined position within the cleaner 228, a surface temperature detecting sensor (not shown) which checks the surface temperature of the heat controller 50 is provided. The longitudinal size of the cleaner 228 is nearly the same as the axial length of heat roller 50 and the nip roller 58. The contact pressure of the cleaner 228 against the circumferential surfaces of the heat roller 50 and the nip roller 58 is set from 50 to 300 g/cm$^2$. Just below the cleaner 228, a vessel 230 is disposed. The vessel 230 holds the substances which were scraped off by the cleaner 228.

Figure 11B:
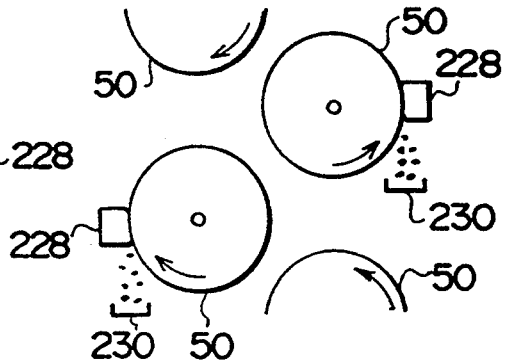
FIG. 11B is an enlarged sectional view according to FIG. 1, the heat rollers being disposed in a zigzag shape, showing a third modified example of tile scraper means of the principal portion of the present invention.

In the modified example shown in FIG. 11B, the roller 58 is omitted. Instead, heat rollers 50 are disposed in a zigzag pattern. Since the rest of the construction of the modified example shown in FIG. 11B is the same as that shown in FIG. 11A, a description is omitted.

Figure 12:
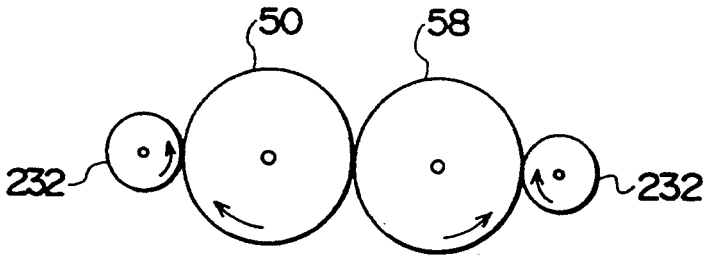
FIG. 12 is an enlarged sectional view according to FIG. 1 showing an example of an adhering means of the principal portions of the present invention, the example being backup rollers.

In the modified example shown in FIG. 12, backup rollers 232 as adhering means are disposed adjacent to the heat roller 50 and the nip roller 58. An adhesive tape (not shown) is wound around the circumferential surface of the backup roller 232 so as to peel off substances deposited on the circumferential surface of the heat roller 50 and the nip roller 58. This tape can be periodically replaced. An adhesive tape which can remove substances deposited and restore adhesive force of the tape by cleaning the circumferential surface of the backup roller 232 may be used. After the film insertion detecting sensor 80 has detected that the film F had been inserted into the automatic developing apparatus 10 and a predetermined period of time has elapsed, the backup rollers 232 move so as to contact the heat roller 50 and the nip roller 58. This predetermine time means a period of time after the film F inserted into the automatic developing apparatus 10 has been detected by the film insertion detecting sensor 80 and the film F has passed through the path defined by the heat roller 50 and the nip roller 58 until substances are deposited on the circumferential surfaces of the heat roller 50 and the nip roller 58. Before the next film F passes through the path defined by the heat roller 50 and the nip roller 58, the backup rollers 232 separate from the heat roller 50 and the nip roller 58. If desired, the backup rollers 232 may be in continuous contact with the heat roller 50 and the nip roller 58.

Figure 13:
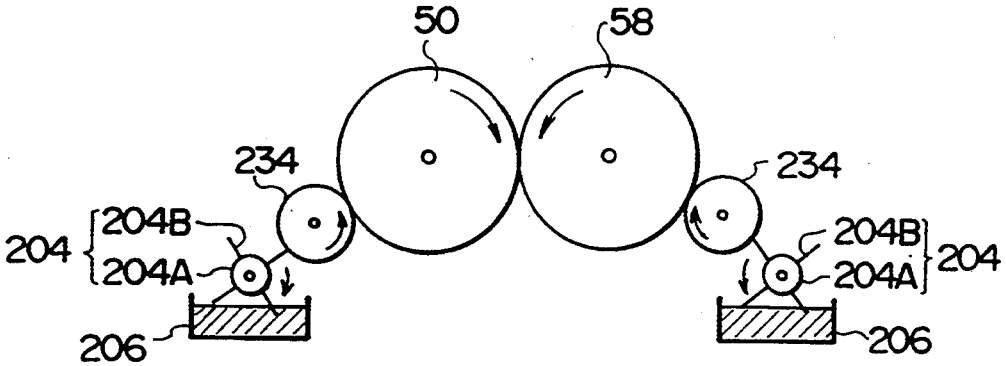

In the modified example shown in FIG. 13, backup rollers 234 serving as second rollers are disposed between the heat roller 50 and the bladed roller 204 and between the nip roller 58 and the bladed roller 204 in the construction shown in FIG. 4. In the construction shown in FIG. 13, cleaning water is supplied to the circumferential surfaces of the heat roller 50 and the nip roller 58 indirectly by the backup rollers 234. Thus, since the heat roller 50 and the nip roller 58 are not damaged by any members, the durability of the heat roller 50 and the nip roller 58 may be improved.

Figure 14:
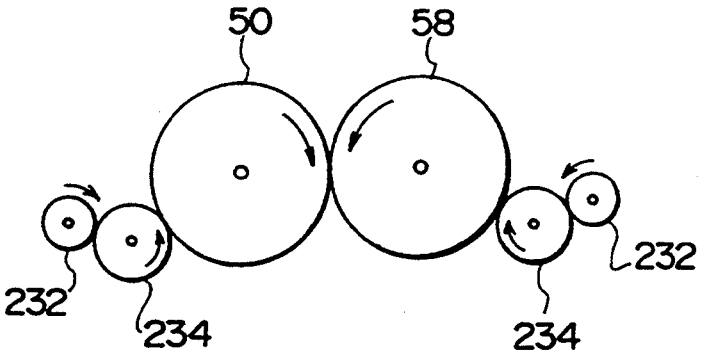
FIG. 14 is an enlarged sectional view showing a first modified example of the backup rollers of FIG. 13, the backup rollers being used for the principal portions of FIG. 12.

In the modified example shown in FIG. 14, with the construction shown in FIG. 12, backup rollers 234 serving as second rollers are disposed between the heat roller 50 and the adhesive backup roller 232 and between the nip roller 232 and the adhesive backup roller 232. Accordingly, water which adheres to the circumferential surfaces of the heat roller 50 and the nip roller 58 is transferred to the backup rollers 234. When substances are deposited on the circumferential surfaces of the backup rollers 234, they adhere to the circumferential surfaces of the backup rollers 232. Thus, the substances deposited on the circumferential surfaces of the backup rollers 232 are removed. A tape may be wound around the backup roller 232 and at the same time the tape may be periodically replaced. An adhesive tape made of a material which can be cleaned and re-used may be also employed. In the construction shown in FIG. 14, as with the modified example shown in FIG. 13, since the heat roller 50 and the nip roller 58 are not damaged by any members, their durability may be improved. The contact and non-contact operations of the backup rollers 232 and the backup rollers 234 are performed in the same manner as those of the modified example shown in FIG. 12.

Figure 15:
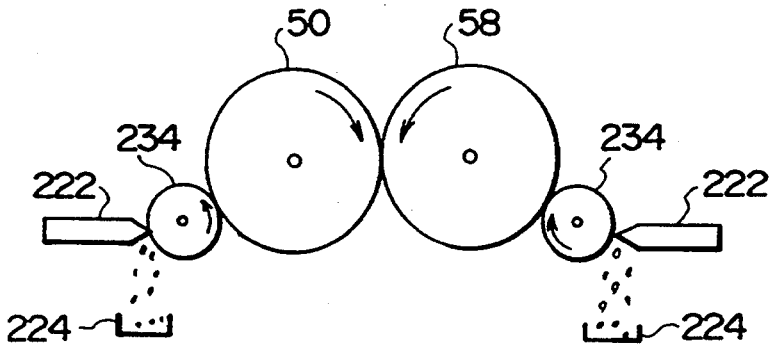
FIG. 15 is an enlarged sectional view showing a second modified example of the backup rollers of FIG. 13, the backup rollers being used for the principal portions of FIG. 9.

In the modified example shown in FIG. 15, with the construction shown in FIG. 9, the backup rollers 234 serving as second rollers are disposed between the heat roller 50 and the blade 222 and between the nip roller 58 and the blade 222. Water which adheres to the circumferential surfaces of the heat roller 50 and the nip roller 58 is transferred to the backup rollers 234. When substances are deposited on the circumferential surfaces of the backup rollers 234, they are scraped off by the blades 222 and accommodated in the containers 224. The effect of the modified example shown in FIG. 15 is similar to that shown in FIG. 9. However, in the type where substances are scraped off by the blades 222, the damage preventing effect of the heat roller 50 and the nip roller 58 is remarkably high.

Figure 16:
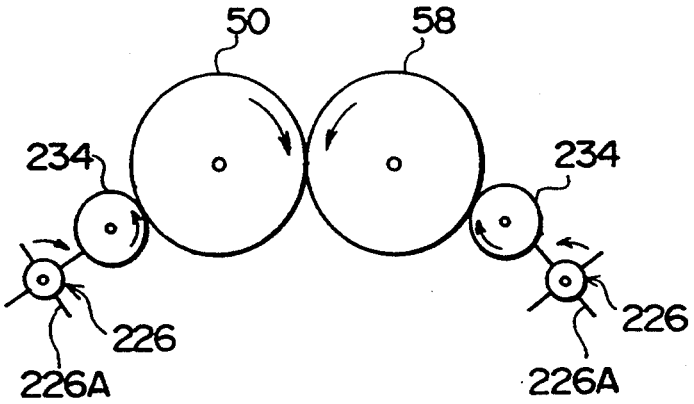
FIG. 16 is an enlarged sectional view showing a third modified example of the backup rollers of FIG. 13, the backup rollers being used for the principal portions of FIG. 10.

In the modified example shown in FIG. 16, with the construction of the modified example shown in FIG. 10, the backup rollers 234 serving as second rollers are disposed between the heat roller 50 and the bladed roller 226 and between the nip roller 58 and the bladed roller 226. The operation and effect of the modified example shown in FIG. 16 are the same as those shown in FIG. 15. Since the operation of the bladed rollers 226 is the same as that shown in FIG. 10, a description is omitted.

Figure 17:
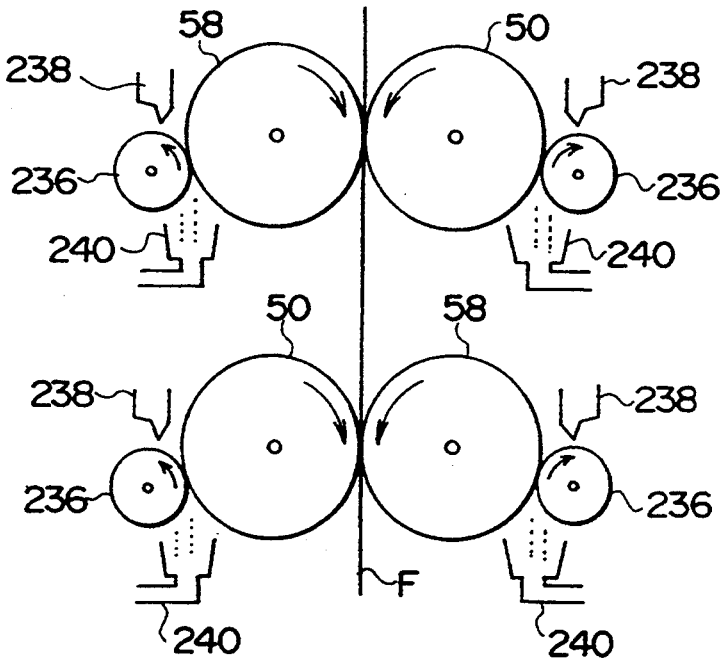
FIG. 17 is an enlarged sectional view showing a fourth modified example of the backup rollers of FIG. 13, the backup rollers being used for the principal portions of FIG. 1.

In the modified example shown in FIG. 17, the heat rollers 50 are in diagonal opposition with the film F (conveying path) therebetween. The nip rollers 58 are also diagonally disposed to each other. The backup rollers 236 as second rollers contact the circumferential surfaces of the heat rollers 50 and the nip rollers 58. Cleaning water is supplied to each backup roller 236 from a nozzle 238. As the backup rollers 236 rotate in the directions of the arrows, the cleaning water is supplied to the heat roller 50 and the nip roller 58. Just below the portion where the backup rollers 236 make contact with the heat rollers 50 and the nip rollers 58, the containers 240 which hold cleaning water supplied from the nozzles 238 are disposed.

Figure 18:
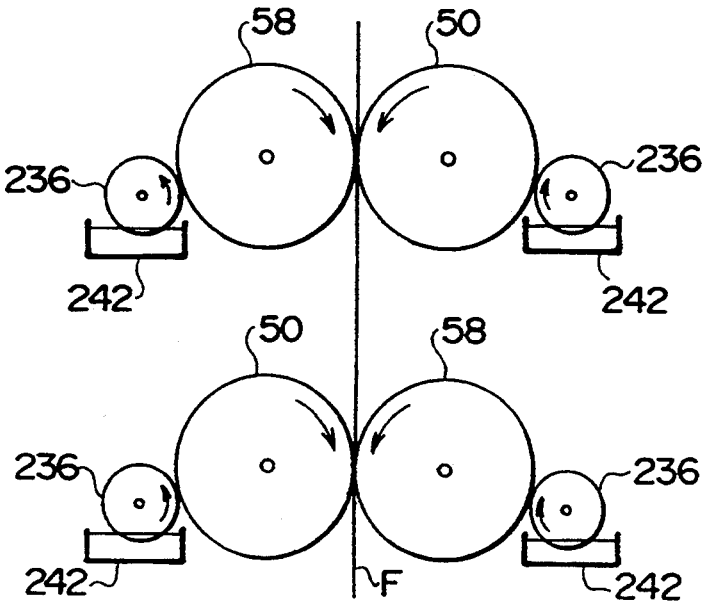
FIG. 18 is an enlarged sectional view showing the principal portions of FIG. 4, the principal portions using backup rollers.
Figure 19:
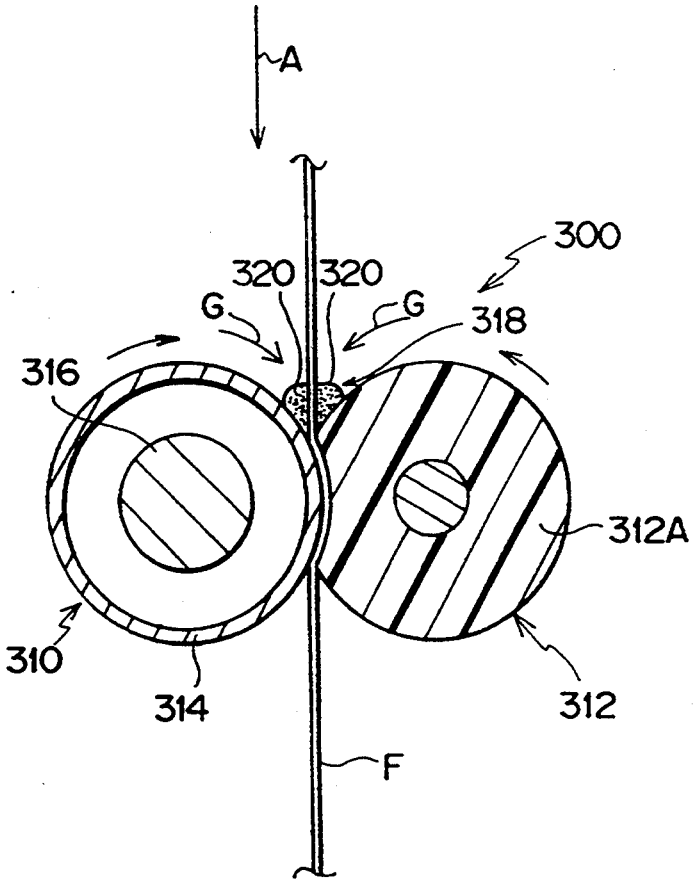
FIG. 19 PRIOR ART
FIG. 19 is an enlarged sectional view of a related art reference according to FIG. 1.

In the modified example shown in FIG. 18, the heat rollers 50, the nip rollers 58, and the backup rollers 236 which serve as second rollers are disposed in the same construction as the modified example shown in FIG. 17. However, instead of the nozzles 238 and the containers 240, water supply tanks 242 are used. In other words, part of the circumference of the backup roller 236 is submerged in the cleaning water accommodated in the water supply tank 242. As the backup rollers 236 rotate in the directions of the arrows, the cleaning water is supplied to the heat rollers 50 and the nip rollers 58. Since the operation and effects of the modified example shown in FIG. 18 are the same as those shown in FIG. 17, its description is omitted.

In the modified examples shown in FIGS. 13 to 18, the backup roller 236 may be covered by an artificial microporous sponge "RUBYCELL" which has water absorbing properties and produced by Toyo Polymer K. K.

Besides the above-described embodiment and various modified examples, a variety of combinations are possible.

The present invention may be applied to photosensitive material processing apparatus which processes other photosensitive materials. For example, printing type, X-ray type, general negative type, general reversal type, general positive type, direct positive type, and so forth.

In addition, in the above-described embodiment, an example where the present invention is applied to the automatic developing apparatus was explained. However, it should be appreciated that the present invention may be applied to any photosensitive material processing apparatus.

Although the present invention has been shown and described, it should be understood by those skilled in the art that the foregoing and various other changes, omissions, and additions in the form and detail thereof may be made therein without departing from the spirit and scope of the present invention.

What is claimed is:

1. A photosensitive material processing apparatus, comprising:

a plurality of rollers whose circumferential surfaces are capable of directly or indirectly contacting a photosensitive material processed by at least one kind of processing solution, at least one of said rollers being adapted to heat and dry said photosensitive material by heat conduction thereof, said rollers being adapted to convey said photosensitive material by rotating of said rollers: and deposit removing means for removing substances deposited on the circumferential surfaces of said rollers.

2. The photosensitive material processing apparatus according to claim 1, wherein said deposit removing means is cleaning water supply means for supplying cleaning water to the circumferential surfaces of said rollers.

3. The photosensitive material processing apparatus according to claim 1, wherein said rollers are a pair of rollers in opposed relation for nipping said photosensitive material on both sides thereof.

4. The photosensitive material processing apparatus according to claim 3, wherein said deposit removing means is cleaning water supply means adapted to supply cleaning water to a nip portion of said opposed roller pair.

5. The photosensitive material processing apparatus according to claim 1, wherein said deposit removing means is scraper means which contact the circumferential surfaces of said rollers, for scraping off substances deposited thereon.

6. The photosensitive material processing apparatus according to claim 1, wherein said deposit removing means is adhesive means, which contact the circumferential surfaces of said rollers, for peeling off substances deposited thereon.

7. The photosensitive material processing apparatus according to claim 2, wherein said cleaning water supply means has a plurality of cleaning water supply pipes provided corresponding to the number of said rollers, said cleaning water supply pipes being adapted to put out said cleaning water onto said rollers.

8. The photosensitive material processing apparatus according to claim 2, wherein said cleaning water supply means has a plurality of water supply rollers provided corresponding to the number of said rollers, each water supply roller being in contact with the circumferential surfaces of corresponding roller of said rollers and being adapted to supply said cleaning water to the corresponding roller.

9. The photosensitive material processing apparatus according to claim 2, wherein said cleaning water supply means has a plurality of blades provided corresponding to the number of said rollers, each of said blades being in contact with the circumferential surfaces of corresponding roller of said rollers and being adapted to supply said cleaning water to the corresponding roller.

10. The photosensitive material processing apparatus according to claim 5, wherein said scraper means is a plurality of blades provided corresponding to the number of said rollers.

11. The photosensitive material processing apparatus according to claim 5, wherein said scraper means is a plurality of friction members provided corresponding to the number of said rollers.

12. The photosensitive material processing apparatus according to claim 6, wherein said adhesive means is adhesive rollers having an adhesive member on the circumferential surface of the adhesive rollers.

13. The photosensitive material processing apparatus according to claim 1, wherein at least one roller being heated is a heat roller having a metal drum with high heat conduction properties and a heater disposed nearly at the rotating axis of said drum.

14. A photosensitive material processing apparatus, comprising:

a plurality of first rollers whose circumferential surfaces are capable of directly or indirectly contacting a photosensitive material processed by at least one kind of processing solution, at least one of said rollers being adapted to heat and dry said photosensitive material by heat conduction, said rollers being adapted to convey said photosensitive material by rotating of said rollers;

a plurality of second rollers provided corresponding to the number of said first rollers, said second rollers making contact with the circumferential surfaces of said first rollers; and deposit removing means making contact with said second rollers, said second rollers acting as intermediate transfer means between said deposit removing means and said first rollers such that said deposit removing means indirectly removes substances deposited on the circumferential surface of said first rollers.

15. The photosensitive material processing apparatus according to claim 14, wherein said deposit removing means is cleaning water supply means for supplying cleaning water onto the circumferential surfaces of said first rollers through said second rollers.

16. The photosensitive material processing apparatus according to claim 14, wherein said deposit removing means is scraper means which contact the circumferential surfaces of said second rollers, for scraping off substances deposited on the circumferential surfaces of said second rollers.

17. The photosensitive material processing apparatus according to claim 14, wherein said deposit removing means is adhesive means which contact the circumferential surfaces of said second rollers, for peeling off substances deposited on the circumferential surfaces of said second rollers.

18. The photosensitive material processing apparatus according to claim 15, wherein said cleaning water supply means has a plurality of cleaning water supply members provided corresponding to the number of said second rollers, said cleaning water supply members being adapted to put out said cleaning water onto said first rollers through said second rollers.

19. The photosensitive material processing apparatus according to claim 15, wherein said cleaning water supply means has a plurality of blades provided corresponding to the number of said second rollers, said blades being in contact with the circumferential surfaces of each corresponding roller of said second rollers so as to supply the cleaning water.

20. The photosensitive material processing apparatus according to claim 16, wherein said scraper means is a plurality of blades provided corresponding to the number of said second rollers.

* * * * *